US007730754B2

(12) United States Patent
Cha et al.

(10) Patent No.: US 7,730,754 B2
(45) Date of Patent: Jun. 8, 2010

(54) APPARATUS AND METHOD FOR MANUFACTURING SPIRAL DUCT

(75) Inventors: Kyu-Seok Cha, Hwaseong-shi (KR); Seok Heo, Hwaseong-shi (KR)

(73) Assignee: Jinwoong Technology (KR)

( * ) Notice: Subject to any disclaimer, the term of this patent is extended or adjusted under 35 U.S.C. 154(b) by 521 days.

(21) Appl. No.: 11/729,356

(22) Filed: Mar. 28, 2007

(65) Prior Publication Data

US 2007/0251285 A1 Nov. 1, 2007

(30) Foreign Application Priority Data

Mar. 30, 2006 (KR) ..... 10-2006-0028859

(51) Int. Cl.
*B21C 37/12* (2006.01)
*B21F 11/00* (2006.01)
*B21B 15/00* (2006.01)

(52) U.S. Cl. ..... 72/50; 72/129; 72/168

(58) Field of Classification Search ..... 72/49, 72/50, 129, 130, 135, 168; 83/333
See application file for complete search history.

(56) References Cited

U.S. PATENT DOCUMENTS 4,287,742 A 9/1981 Heiman ..... 72/49
5,014,424 A 5/1991 Takasugi ..... 29/890.149

FOREIGN PATENT DOCUMENTS

| | | | |
|---|---|---|---|
| CH | 645 288 | | 9/1984 |
| CH | 645288 | A5 * | 9/1984 |
| EP | 0 400 576 | | 12/1990 |
| JP | 59-215215 | | 12/1984 |
| KR | 950003300 | B | 4/1995 |

* cited by examiner

*Primary Examiner*—Dana Ross
*Assistant Examiner*—Teresa M Bonk
(74) *Attorney, Agent, or Firm*—Jae Y. Park; Kile Goekjian Reed & McManus

(57) ABSTRACT

Provided are an apparatus and method for manufacturing a spiral duct in which straight connection parts are integrally formed with both ends of a curved duct. Further provided are an apparatus and method for manufacturing a spiral duct capable of improving cutting quality of a metal band and precisely and securely coupling bent parts of edges of the metal band. The apparatus comprises a cutting roll to cut a metal band into two parts, the cutting roll having a horizontal rotation angle that can be varied to cut along a straight or a waved line in order to form a duct having straight and curved parts, and in order to adjust a diameter of the duct. In addition, the apparatus includes rolls for forming bent parts at edges of the cut metal bands, and for winding and seaming edges of the metal bands to form ducts.

1 Claim, 12 Drawing Sheets

APPARATUS AND METHOD FOR MANUFACTURING SPIRAL DUCT

CROSS-REFERENCE TO RELATED APPLICATION

This application claims the benefit of Korean Patent Application No. 2006-0028859, filed on Mar. 30, 2006, the disclosure of which is hereby incorporated herein by reference in its entirety.

BACKGROUND OF THE INVENTION

1. Field of the Invention

The present invention relates to an apparatus and method for manufacturing a spiral duct, and more particularly, to an apparatus and method for manufacturing a spiral duct capable of readily manufacturing a spiral duct in which straight connection parts are integrally formed with both ends of a curved duct, and securely coupling a bent part formed at a straight edge with a bent part formed at a waved part to prevent generation of inferior products by smoothly cutting a metal band along a waved line in its longitudinal direction.

2. Description of the Prior Art

A curved duct in which a band-shaped metal plate is wound in a spiral shape, and side edges of the metal plate are hooked and coupled to each other is disclosed in several prior arts.

However, in the prior arts, since the metal band is continuously cut to form large width parts and small width parts and then residual parts are discarded, the metal band is wasted.

In order to prevent waste of the material, Korean Patent Laid-open Publication No. 1990-17678 discloses "METAL BAND FOR MANUFACTURING SPIRAL DUCT", as shown in FIG. 1.

Specifically, a single sheet of metal band is cut into two metal bands, each of which has large width parts and small width parts, which are alternately formed in its longitudinal direction. That is, each of the metal bands has one straight side edge and the other waved side edge, thereby minimizing waste of the metal band.

Using one of the two metal bands, a dual bent part is formed at the straight side edge and a single bent part is formed at the waved side edge along the entire length in an upright posture. The metal band is wound in a spiral manner, and simultaneously, the large width part is positioned at an outer curved part and the small width part is positioned at an inner curved part. Next the single bent part and the dual bent part, which are adjacent to each other, are sequentially inserted and then pressed to complete the curved duct.

FIG. 2 shows a conventional apparatus for manufacturing a curved duct.

As shown, a metal band 3 is extracted between first forming rollers 11 of the apparatus for manufacturing a curved duct to form two L-shaped bent parts 4 at both side edges of the metal band 3.

Next, the L-shaped bent parts 4 are bent again by a pair of upper and lower forming rollers 14 disposed in front of the first rollers 11 to form approximately C-shaped dual bent parts 5.

Then, as shown in FIG. 3, the metal band 3 having the dual bent parts 5 is cut and divided by a female roller 18 having a waved groove 17 formed at its outer periphery and the same diameter as the curved duct, and a male roller 20 having a waved blade 19 corresponding to the waved groove 17.

In addition, at the same time the metal band 3 is cut, both cut edges are pushed into the groove 17 by the blade 19 to form L-shapes, thereby forming a pair of single bent part 6.

Further, as shown in FIG. 4, the single bent parts 6 of the two metal bands 2 are bent toward the dual bent parts 5 by an upper support roller 21 disposed in the front, and a third lower forming roller 25 having an approximately diamond shape and axially supported by a bearing 24 of a slider 23 slidably inserted into a horizontal guide shaft 22.

As described above, the conventional apparatus for manufacturing a curved duct includes the male roller 20 having the waved blade 19 formed at its outer periphery, and the female roller 18 having the waved groove 17 corresponding to the waved blade 19, to thereby cut a metal band between the waved blade 19 and the waved groove 17.

In addition, as shown in FIG. 5, the spirally wound metal band is manufactured by contacting the waved edge with the straight edge, and pressing forward by a reciprocating roller 36 such that the reciprocating roller 36 moves backward at a convex part of the waved edge and moves forward at a concave part of the waved edge, thereby automatically coupling the dual bent part 5 with the single bent part 6.

However, when the metal band is cut by the roller having the blade or the groove formed at its outer surface, it is not possible to cut a metal band having a predetermined length of straight part. As a result, it is difficult to manufacture a duct in which straight connection ducts are integrally formed with both ends of a curved duct.

In addition, when the metal band is cut by the roller having the blade or the groove formed at its outer surface, the cut part may be readily rough, and thus, it is difficult to precisely form the single bent part and securely couple the single bent part with the dual bent part.

SUMMARY OF THE INVENTION

An embodiment of the present invention provides an apparatus and method for manufacturing a spiral duct in which straight connection ducts are integrally formed with both ends of a curved duct.

Another embodiment of the present invention provides an apparatus and method for manufacturing a spiral duct capable of improving cutting quality of a metal band and precisely and securely coupling bent parts of edges to thereby remarkably increase yield of curved ducts.

An aspect of the invention provides an apparatus for manufacturing a spiral duct including: a first edge forming roll for forming dual bent parts at both straight edges of a metal band; a cutting roll for cutting the metal band extracted from the first edge forming roll in a waved shape by periodically varying a horizontal rotation angle or in a straight shape in its longitudinal direction; and a seaming device for coupling a single bent part with the dual bent part winding the cut metal band in a spiral shape.

A second edge forming roll may be disposed in front of the cutting roll in feeding direction of the metal band to form the single bent part at the waved edge of the cut metal band.

The cutting roll may include a scribing roll for scribing a waved line or a straight line in a longitudinal direction of the metal band, and a partitioning roll for dividing the metal band along the waved line or the straight line.

In addition, the first edge forming roll may include an outward tilt forming roll, a vertical part forming roll, and an inward tilt forming roll.

Further, the outward tilt forming roll, the scribing roll, the vertical part forming roll, the partitioning roll, the inward tilt forming roll, and the second edge forming roll may be sequentially disposed.

Furthermore, the second edge forming roll may be installed to be linked to the scribing roll and the partitioning roll to vary a horizontal rotation angle of the second edge forming roll.

Another aspect of the invention provides a method of manufacturing a spiral duct including: supplying a metal band; forming an outward bent part, a vertically bent part, and an inward bent part at both straight edges of the metal band; periodically varying a horizontal rotation angle of a cutting roll to cut the metal band in a waved shape in its longitudinal direction to divide the metal band into two cut metal bands; forming a single bent part at the waved edge and a dual bent part at the straight edge; and coupling the single bent part with the dual bent part winding the cut metal band.

The cutting roll may be disposed parallel to the metal band at an introduction part and a termination part of the metal band to divide the metal band into straightly cut metal bands, and to wind the cut metal band such that straight connection ducts are integrally formed with both ends of a curved duct.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF EXEMPLARY EMBODIMENTS

Figure 1:
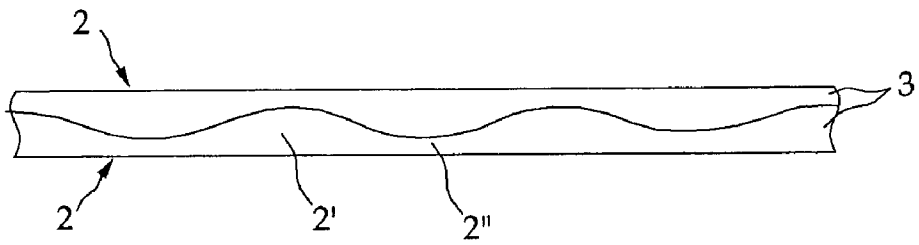
Fig. 1 (Prior Art)
FIG. 1 is a plan view of a cut state of a metal band for manufacturing a spiral duct.
Figure 2:
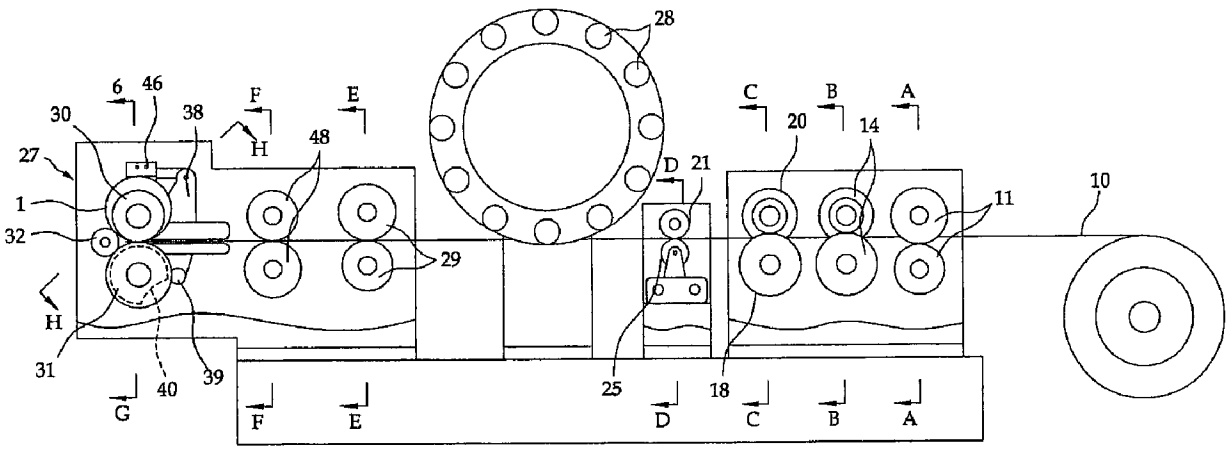
Fig. 2 (Prior Art)
FIG. 2 is a side view of a conventional apparatus for manufacturing a spiral duct.
Figure 3:
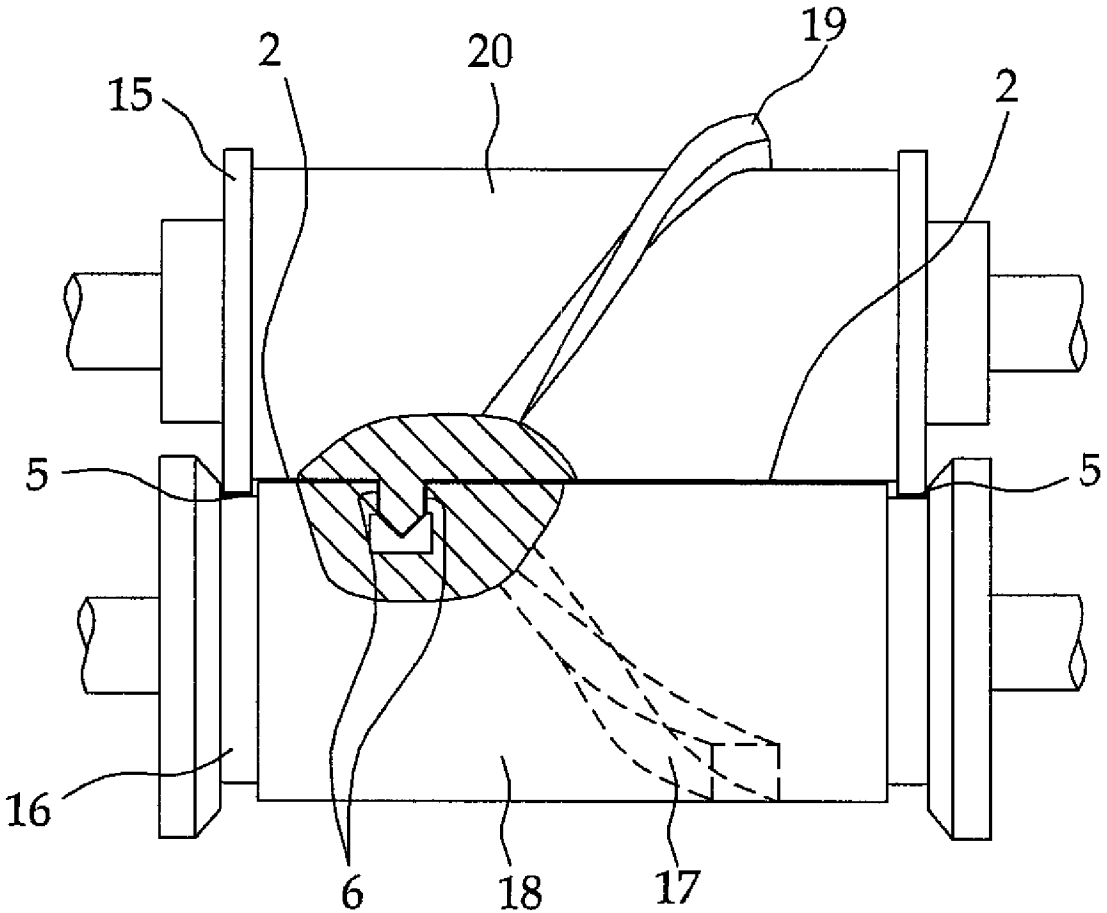
Fig. 3 (Prior Art)
FIG. 3 is a front view of a cutting roll of FIG. 2.
Figure 4:
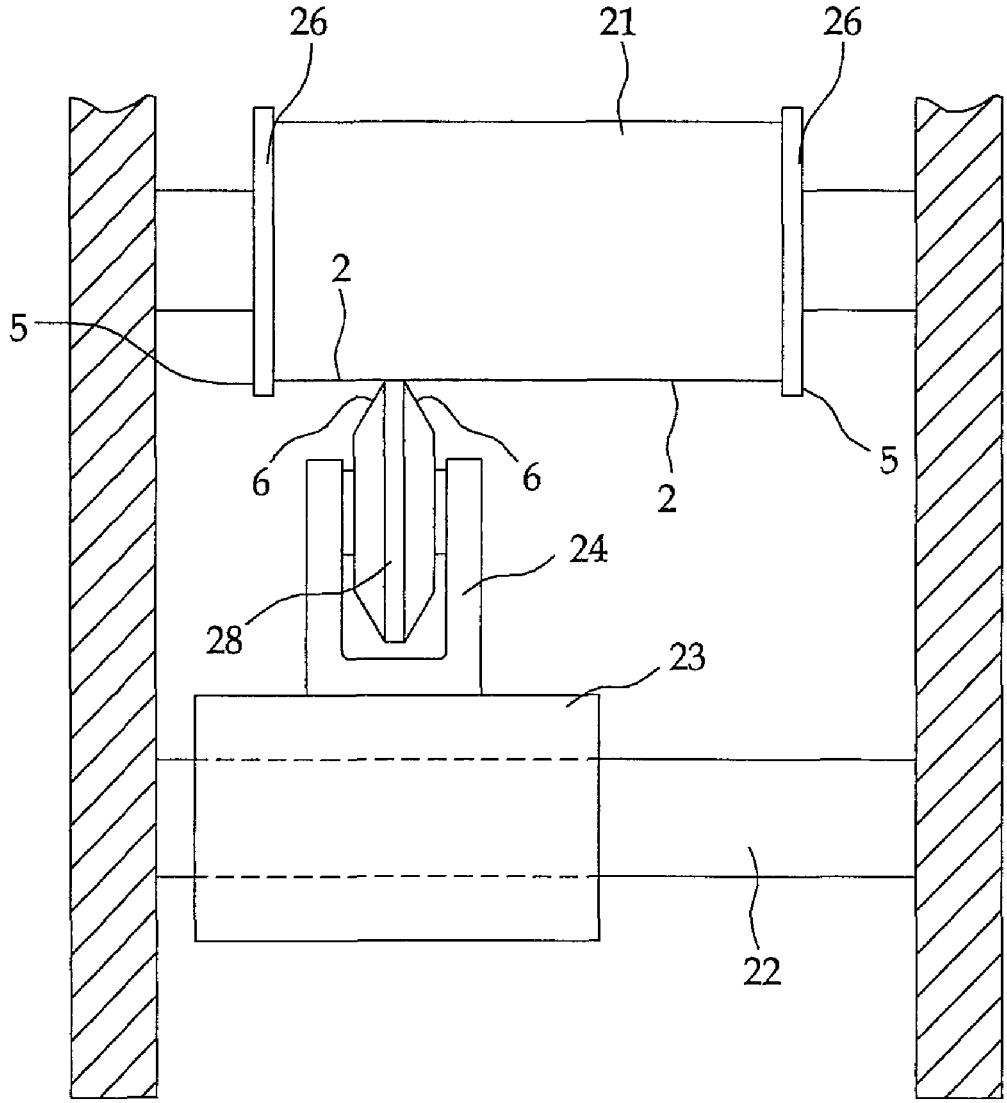
Fig. 4 (Prior Art)
FIG. 4 is a front view of a finish-forming roll of FIG. 2.
Figure 5:
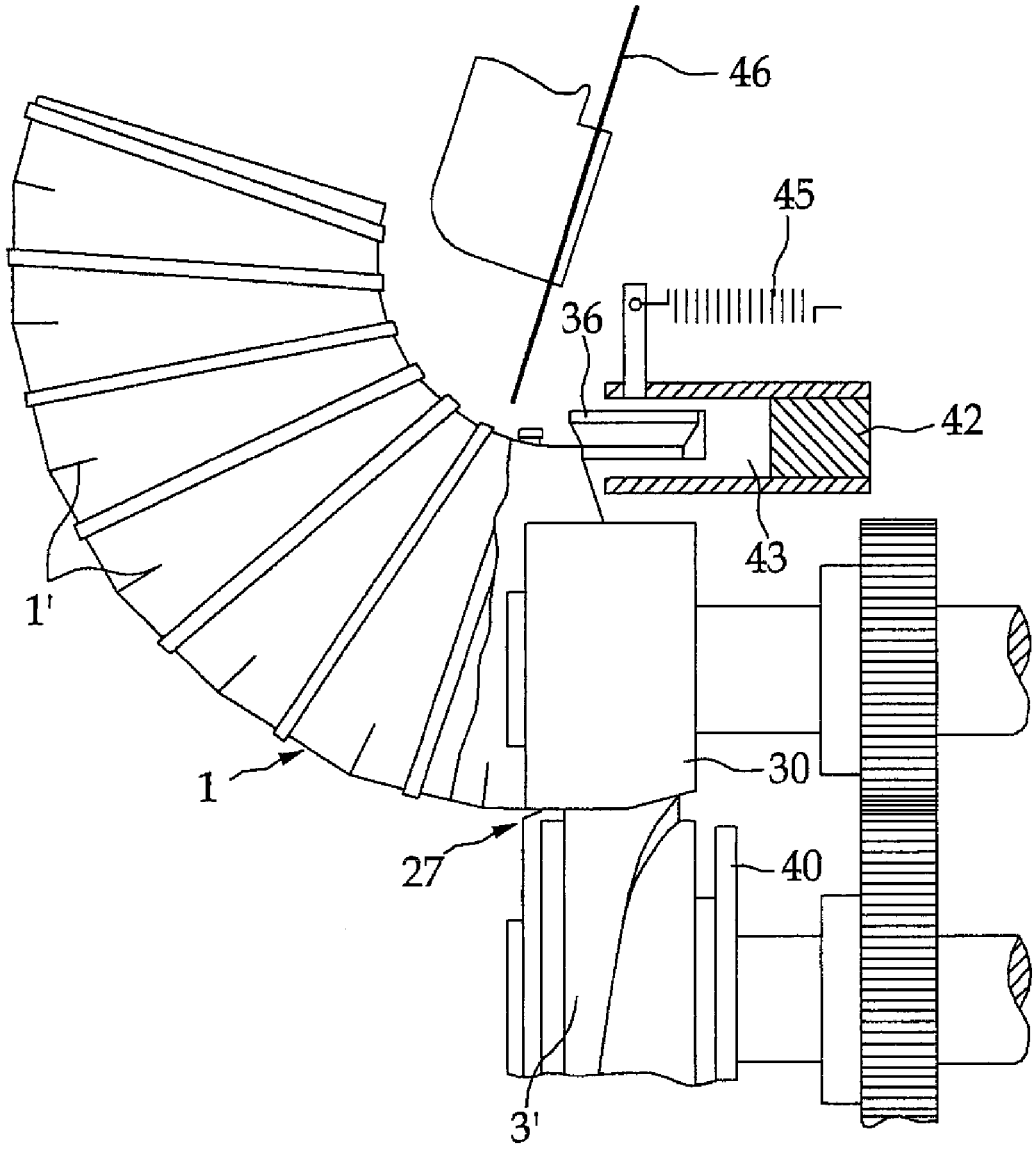
Fig. 5 (Prior Art)
FIG. 5 is a front view of a seaming device of FIG. 2.

Hereinafter, exemplary embodiments of the present invention will be described with reference to the accompanying drawings.

Referring to FIGS. 6A to 17, an apparatus 1000 for manufacturing a spiral duct in accordance with an exemplary embodiment of the present invention includes a first edge forming roll 100, a cutting roll 200, a second edge forming roll 400, and a seaming device 500.

Here, the first edge forming roll 100 functions to form dual bent parts 310 at both straight edge parts of a metal band 300.

Figure 6A:
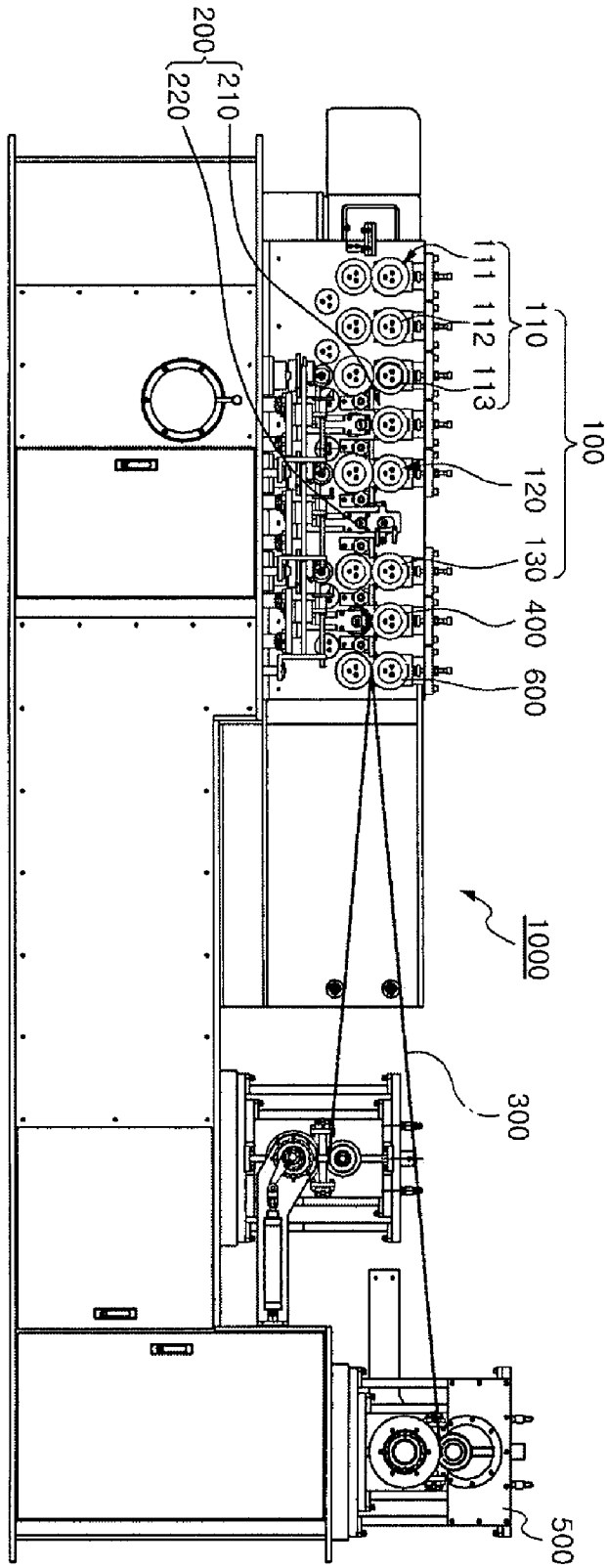
FIG. 6A is a side view of an apparatus for manufacturing a spiral duct in accordance with an exemplary embodiment of the present invention.

Specifically, the first edge forming roll 100 includes an outward tilt forming roll 110, a vertical part forming roll 120, and an inward tilt forming roll 130. The outward tilt forming roll 110, the vertical part forming roll 120, and the inward tilt forming roll 130 may not be sequentially arranged, and as shown in FIG. 6A, may be arranged between the cutting rolls 200.

In addition, the outward tilt forming roll 110 includes three rolls 111, 112 and 113 such that both straight edges of the metal band 300 are formed to have dual bent parts 310.

Figure 7:
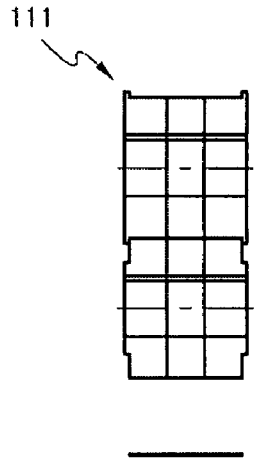
FIG. 7 is a cross-sectional view of the first tilt forming roll in FIG. 6.

First, as shown in FIG. 7, the first tilt forming roll 111 disposed at a tip of the forming roll 110 functions to supply and flatten the entire metal band.

Figure 8:
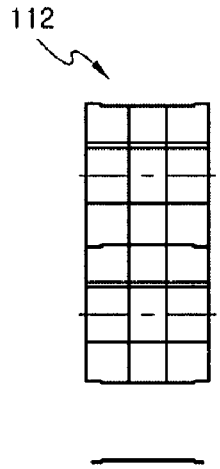
FIG. 8 is a cross-sectional view of the second tilt forming roll in FIG. 6.

Next, as shown in FIG. 8, the second tilt forming roll 112 functions to slightly bend the both straight edges of the metal bands downward.

Figure 9:
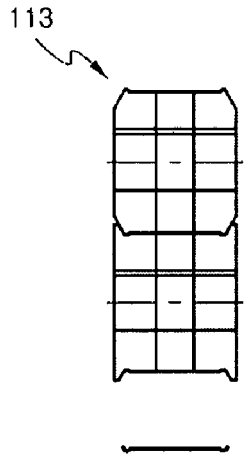
FIG. 9 is a cross-sectional view of the third tilt forming roll in FIG. 6.

In addition, as shown in FIG. 9, the third tilt forming roll 113 functions to bend the both straight edges of the metal band upward again to form outward bent parts, thereby forming dual bent parts 310. In this case, the bent angle is about 60°.

Meanwhile, the cutting roll 200 is disposed to cut the metal band 300 extracted from the first edge forming roll 100 in a waved shape in its longitudinal direction. The cutting roll 200 is installed to vary its horizontal rotation angle.

As shown in FIG. 6A, the cutting roll 200 includes a scribing roll 210 for forming a waved line in a longitudinal direction of the metal band 300, and a partitioning roll for dividing the metal band into two cut metal bands along the waved line.

Figure 10:
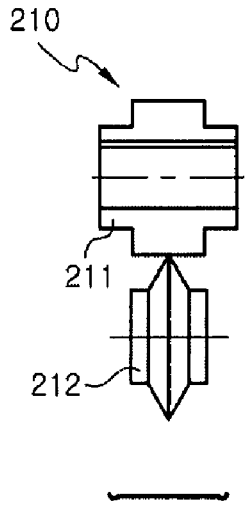
FIG. 10 is a cross-sectional view of scribing roll in FIG. 6.

First, as shown in FIG. 10, the scribing roll 210 includes an upper cylindrical roll 211, and a lower diamond-shaped sharp roll 212. The lower roll 212 is horizontally rotated to scribe the waved line at the metal band 300 supplied between the both rolls. If previously scribing the waved line, it is possible to more readily partition the metal band.

Figure 12:
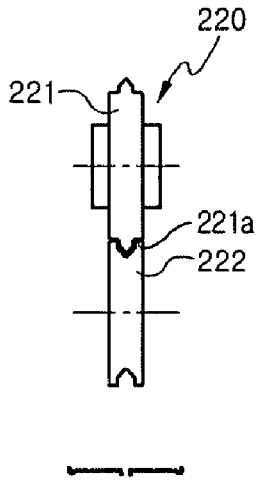
FIG. 12 is a cross-sectional view of partitioning roll in FIG. 6.

Next, as shown in FIG. 12, the partitioning roll 220 includes an upper roll 221 having a sharp peripheral blade, and a lower roll 222 having a groove corresponding to the blade. The upper roll 221 has parallel annular parts 221*a* formed at both sides of the blade and having a predetermined width such that the metal band is divided into two cut parts and simultaneously the divided edges are bent in a "⌉" shape.

In order to form the waved edge, the upper roll 221 and the lower roll 222 of the partitioning roll 220 should simultaneously vary their horizontal rotation angles. For this purpose, rotary shafts of the upper roll 221 and the lower roll 222 are engaged with each other.

Figure 11:
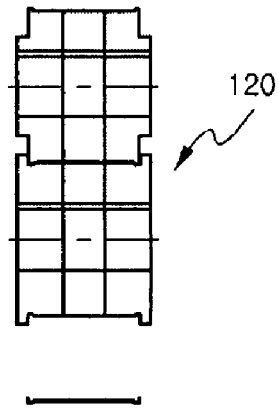
FIG. 11 is a cross-sectional view of vertical part forming roll in FIG. 6.

In addition, as shown in FIG. 11, the vertical part forming roll 120 is disposed between the scribing roll 210 and the partitioning roll 220 in order to vertically stand the both straight edges of the metal band. That is, the edges bent upward by about 60° are additionally bent by about 30° such that the edges are vertically stood.

Figure 13:
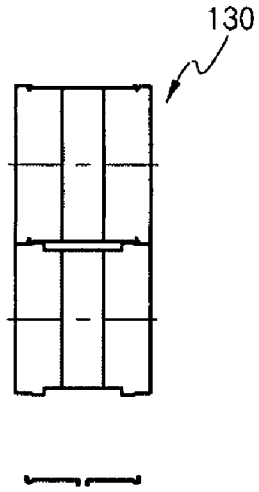
FIG. 13 is a cross-sectional view of inward tilt forming roll in FIG. 6.

Meanwhile, as shown in FIG. 13, the inward tilt forming roll 130 is disposed behind the partitioning roll 220 to form inward bent part by bending the vertically stood straight edges of the metal band inward. As described below, the waved edge is coupled with the inward bent straight edges. At this time, the bent angle is about 30°.

In addition, the second edge forming roll 400 is disposed behind the inward tilt forming roll 130 to form single bent parts 320 at the waved edges of the metal band 300.

Figure 14:
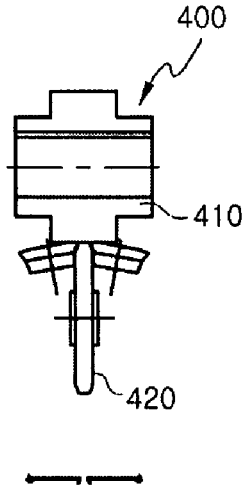
FIG. 14 is a cross-sectional view of the second edge forming roll in FIG. 6.

As shown in FIG. 14, the second edge forming roll 400 includes an upper cylindrical roll 410, and a lower roll 420 for additionally bending the "]" shaped waved edges of the cut metal bands inward to form the single bent parts 320. For this purpose, the lower roll 420 has a curved convex periphery. At this time, the bent angle of the waved edges is approximately 20°.

In addition, the second edge forming roll 400 should also be installed to be rotated horizontally, similar to the cutting roll 200.

For this purpose, in the embodiment, the lower rolls of the scribing roll 210, the partitioning roll 220, and the second edge forming roll 400 are connected to each other to be driven by a drive mechanism 800. Of course, the lower roll of the portioning roll 220 is engaged with the upper roll thereof.

Therefore, while manufacturing the duct, the scribing roll 210, the partitioning roll 220, and the second edge forming roll 400 operate together to precisely cut the metal band and form the duct.

Figure 6B:
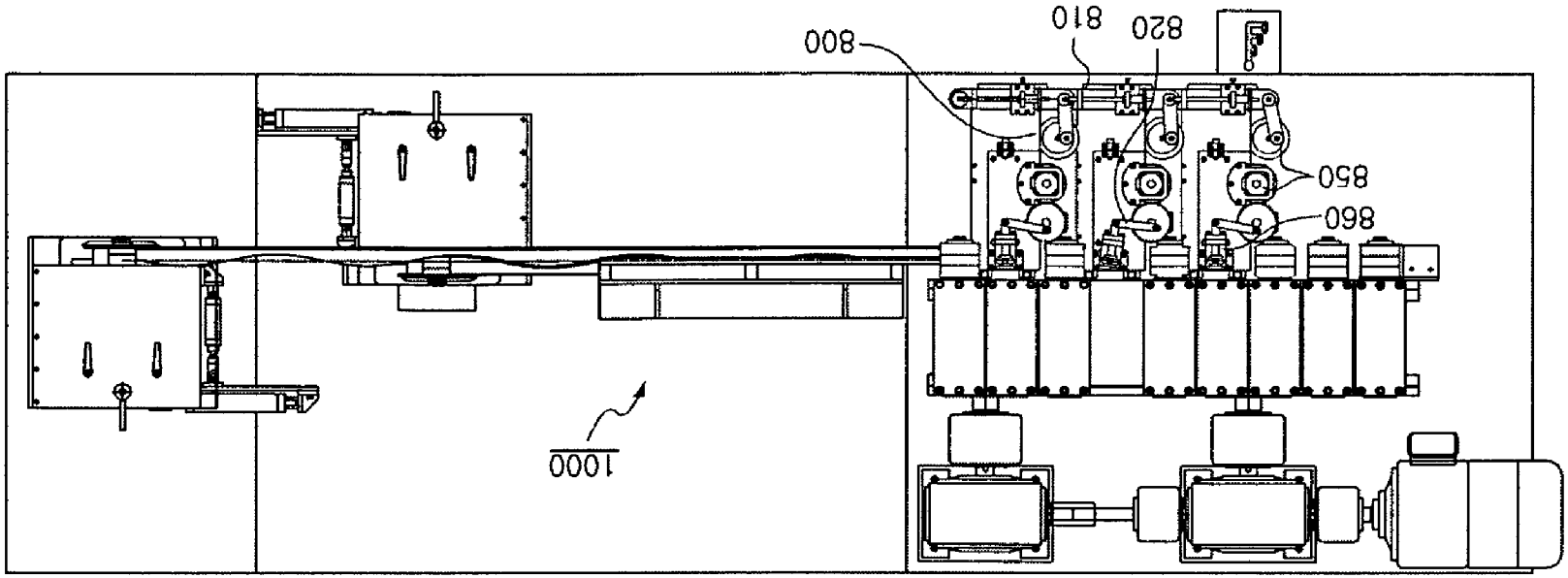
FIG. 6B is a plan view of the apparatus for manufacturing a spiral duct in accordance with an exemplary embodiment of the present invention.

In FIG. 6B, it is shown that the lower rolls of the scribing roll 210, the partitioning roll 220, and the second edge forming roll 400 are connected to each other to be driven by the drive mechanism 800 to change their directions.

Specifically, the drive mechanism 800 includes a servomotor 850, and a wave tracking cam 860 for applying a predetermined amplitude and period to the lower rolls using the servomotor 850. Therefore, the lower rolls can oscillate rotationally and periodically with the predetermined amplitude and period depending on operation of the wave tracking cam 860. In FIG. 6B, reference numeral 810 designates an amplitude cam.

In FIG. 6B, three drive mechanisms 800 are disposed in one lateral side of the scribing roll 210, the partitioning roll 220 and the second edge forming roll 400. In this case, when the metal band is cut the three lower rolls are positioned in different postures; for example, the partitioning roll 220 is disposed in a posture tilted by a link 820.

Figure 15:
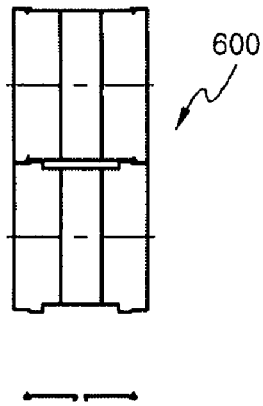
FIG. 15 is a cross-sectional view of guide roll in FIG. 6.

Meanwhile, as shown in FIG. 15, a guide roll 600 is disposed behind the second edge forming roll 400 to guide the divided metal bands to the seaming device 500.

Figure 6C:
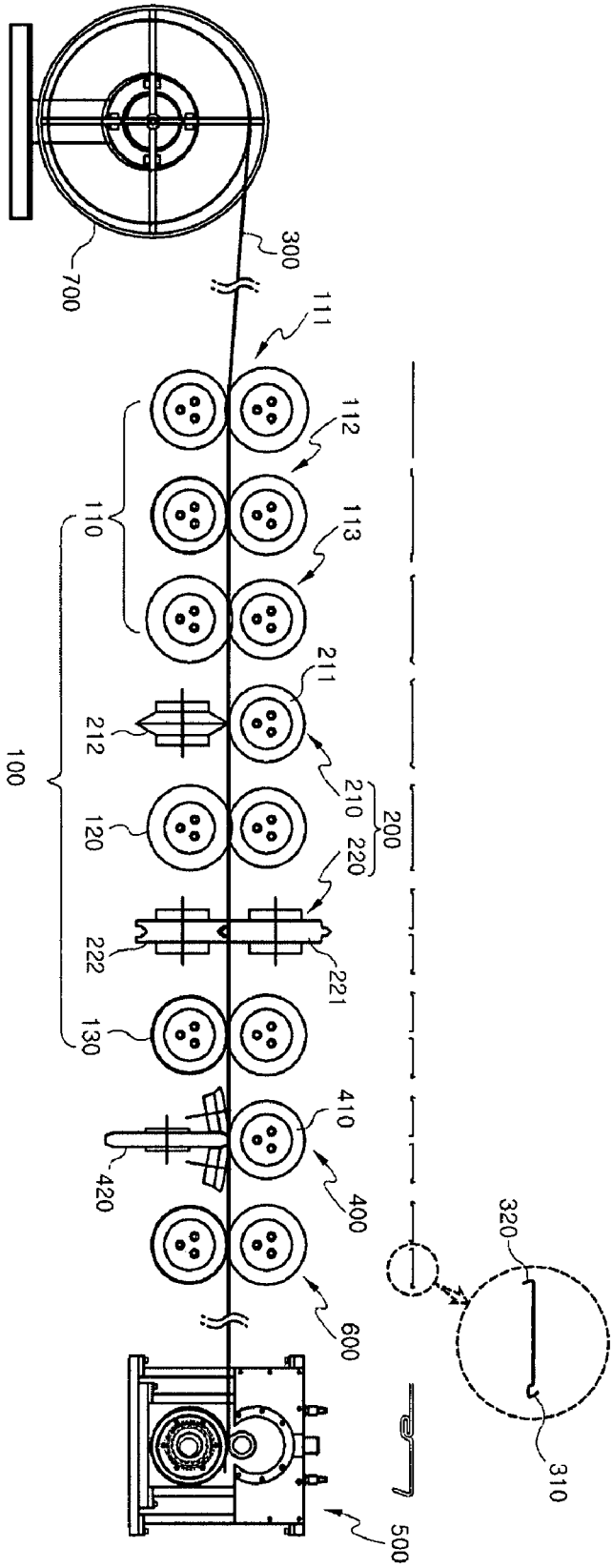
FIG. 6C is a side view of the apparatus for manufacturing a spiral duct in accordance with an exemplary embodiment of the present invention.
Figure 16:
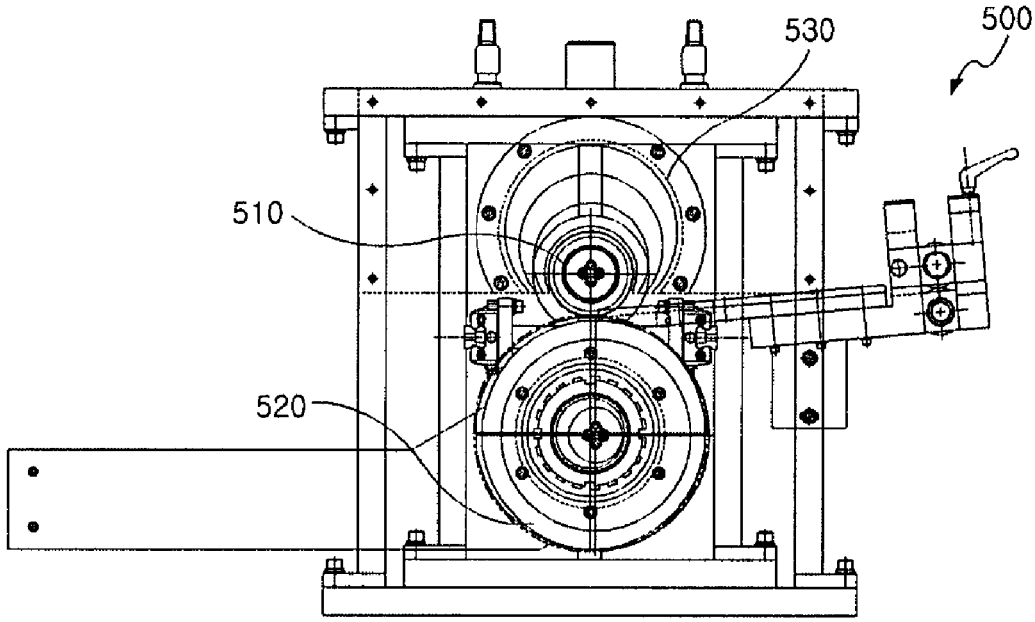
FIG. 16 is a front view of a curved duct forming apparatus of FIG. 6.

In addition, as shown in FIG. 16, the seaming device 500 is a device for coupling the single bent part 320 with the dual bent part 310 at a seaming part winding the cut metal band for forming a spiral shape as shown in FIG. 6C. The seaming device 500 includes two rollers 510 and 520 opposite to each other. When the metal band is inserted between the two rollers 510 and 520 and then pressed, the single bent part 320 is securely coupled with the dual bent part 310 to complete the duct. In this case, the duct is manufactured while being precisely guided by a duct guide 530.

Of course, the seaming device 500 may be similar to the prior art described above.

Eventually, the outward tilt forming roll, the scribing roll, the vertical part forming roll, the partitioning roll, and the inward tilt forming roll, and the second edge forming roll are sequentially disposed.

If the single bent parts 320 bent into a "]" shape by the cutting roll 200 are guided and additionally bent by a seaming device 500 or an appropriate guide device (not shown) in front thereof, the second edge forming roll 400 may be omitted.

Hereinafter, operation of the apparatus for manufacturing a spiral duct in accordance with an exemplary embodiment of the present invention will be described.

First, a metal band 300 wound on an uncoiler 700 in a coil shape is supplied to forming rolls.

The entire metal band 300 is flattened through a first tilt forming roll 111 of the forming rolls.

Next, the metal band 300 passes through a second tilt forming roll 112 so that both straight edges of the metal band are bent downward.

Then, the metal band 300 passes through a third tilt forming roll 113 so that the downward bent straight edges of the metal band are bent upward to form outward bent parts, which are to be formed as dual bent parts 310.

Then, the metal band 300 passed through the third tilt forming roll 113 passes through a scribing roll 210 to be scribed in a waved line at a bottom surface of the metal band 300. At this time, a rotation angle of the scribing roll 210 should be periodically changed in a horizontal direction.

Next, the tilted straight edges of the metal band pass through a vertical part forming roll 120 to be formed into vertically bent part.

In addition, the metal band passes through a partitioning roll 220 with varying its horizontal rotation angle continuously to be cut along the waved line and divided the metal band into two cut metal bands. At the same time the metal band is cut along the waved line, "]" shaped single bent parts are formed at the waved edges.

Next, the vertically stood parts of both straight edges of the metal band are additionally bent inward by an inward tilt forming roll 130.

Then, the waved edges of the metal band 300 pass through a second edge forming roll 400 to be formed into the single bent parts bent 320 bent outward.

Further, the divided metal bands go out through a guide roll 600, and each of the two discharged metal bands is supplied to a seaming device 500 so that the metal band is wound, the single bent part 320 and the dual bent part 310 are coupled and then pressed at their connection parts to form a secure duct.

Figure 17A:
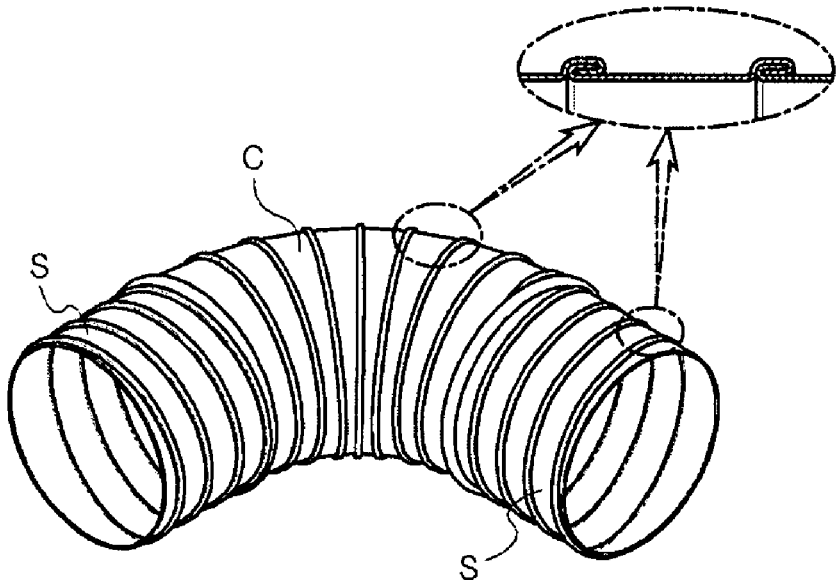
FIGS. 17A and 17B are a perspective view and a deployment view of an apparatus for manufacturing a spiral duct in accordance with an exemplary embodiment of the present invention, respectively.
Figure 17B:
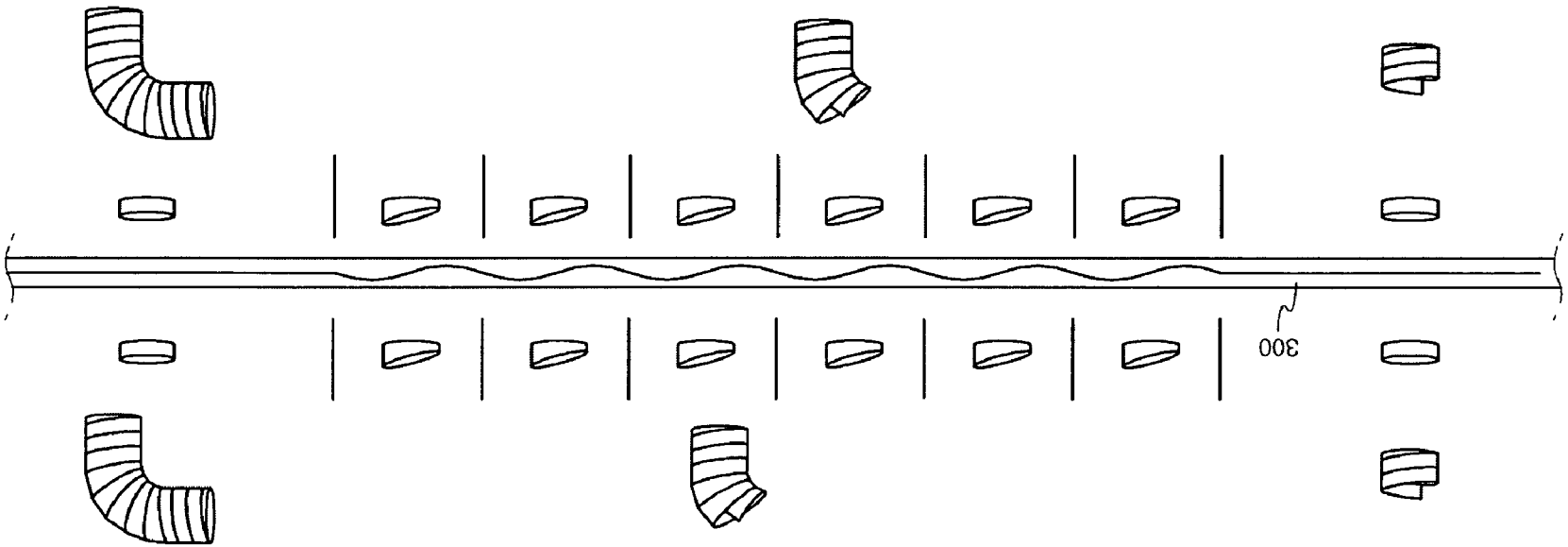

Moreover, as shown in FIGS. 17A and 17B, when the cutting roll is disposed parallel to the metal band at an introduction part and a termination part of the metal band so as to cut the metal band into two straight parts, and then each cut metal band is wound, it is possible to manufacture a duct in which straight connection ducts S are integrally formed with a curved duct C.

As can be seen from the foregoing, since a horizontal rotation angle of a cutting roll is periodically varied to continuously cut a metal band along a straight line and a waved line, it is possible to form a duct in which straight connection ducts are integrally formed with a curved duct.

In addition, it is possible to vary the period and amplitude of a waveform, along which the metal band is cut by the cutting roll, to freely adjust a diameter of the duct.

Further, since the cut parts of the metal band is smoother than the conventional art in which a blade and a groove are formed at surfaces of two rolls, it is possible to precisely and securely couple a single bent part with a dual bent part at their seam parts.

While this invention has been described with reference to exemplary embodiments thereof, it will be clear to those of ordinary skill in the art to which the invention pertains that various modifications may be made to the described embodiments without departing from the spirit and scope of the invention as defined in the appended claims and their equivalents.

What is claimed is:

1. A method of manufacturing a spiral duct comprising:

supplying a metal band having two straight longitudinal edges extending in a longitudinal direction of the metal band;

forming dual bent parts at each straight longitudinal edge of the metal band;

cutting the metal band in the longitudinal direction into two cut metal bands by varying a horizontal rotation angle of a cutting roll such that each cut metal band has a cut edge extending substantially in the longitudinal direction and having straight and waved portions, and a straight edge corresponding to one of the two straight longitudinal edges of the metal band;

forming single bent parts at the cut edge of each cut metal band; and coupling the single bent part with the dual bent part of each cut metal band while helically winding the cut metal bands to make continuous ducts having integrally formed curved and straight duct parts.

* * * * *